US010364113B2

(12) United States Patent
Malmqvist et al.

(10) Patent No.: US 10,364,113 B2
(45) Date of Patent: Jul. 30, 2019

(54) APPARATUS FOR WINDING A WEB OF PAPER MATERIAL AND A METHOD OF REMOVING DUST

(71) Applicant: VALMET AKTIEBOLAG, Sundsvall (SE)

(72) Inventors: Per-Olof Malmqvist, Karlstad (SE); Massimiliano Candutti, Gorizia (IT); Tomas Carlsson, Hammaroe (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 16/082,495

(22) PCT Filed: Feb. 27, 2017

(86) PCT No.: PCT/EP2017/054449
§ 371 (c)(1),
(2) Date: Sep. 5, 2018

(87) PCT Pub. No.: WO2017/190864
PCT Pub. Date: Nov. 9, 2017

(65) Prior Publication Data

US 2019/0077624 A1 Mar. 14, 2019

(30) Foreign Application Priority Data

May 4, 2016 (SE) ..... 1650602

(51) Int. Cl.
*B65H 18/22* (2006.01)
*B65H 18/10* (2006.01)

(52) U.S. Cl.
CPC ..... *B65H 18/22* (2013.01); *B65H 18/10* (2013.01); *B65H 2301/41468* (2013.01);
(Continued)

(58) Field of Classification Search
CPC ..... B65H 18/08; B65H 18/10; B65H 18/26; B65H 18/22; B65H 2301/41468;
(Continued)

(56) References Cited

U.S. PATENT DOCUMENTS 5,901,918 A 5/1999 Klerelid et al.
5,944,273 A * 8/1999 Lin ..... B65H 18/22 242/160.4
(Continued)

FOREIGN PATENT DOCUMENTS

CN 103569707 A 2/2014
EP 1505021 A1 2/2005
(Continued)

OTHER PUBLICATIONS

International Searching Authority, International Search Report and Written Opinion for International Application No. PCT/EP2017/054449, dated May 31, 2017, 11 pages, European Patent Office, Netherlands.

*Primary Examiner* — Jeremy R Severson
(74) *Attorney, Agent, or Firm* — Alston & Bird LLP

(57) ABSTRACT

The invention relates to an apparatus for winding a paper web. It comprises a rotatably mounted reel spool (3) onto which paper can be wound and an endless flexible belt (5) which is permeable to air and supported by support rolls (12). The flexible belt is positioned adjacent the reel spool (3) to engage the web against the reel spool during winding such that the endless flexible belt is deflected from the path of travel. The flexible belt has a web-contacting side (6). An actuator (9) is arranged to position the reel spool (3) and the flexible belt relative to each other to vary the amount of deflection. The apparatus further comprises a cleaning device (11) with at least one nozzle for blowing air against the web-contacting side of the flexible belt at a point where
(Continued)

the flexible belt is not in contact with the paper. The invention also relates to a method of removing dust particles.

17 Claims, 5 Drawing Sheets

(52) U.S. Cl.
CPC ..... *B65H 2406/122* (2013.01); *B65H 2406/3124* (2013.01); *B65H 2407/51* (2013.01); *B65H 2511/142* (2013.01); *B65H 2511/22* (2013.01); *B65H 2557/51* (2013.01); *B65H 2701/177* (2013.01); *B65H 2801/84* (2013.01)

(58) Field of Classification Search
CPC ..... B65H 2557/51; B65H 2701/177; B65H 2801/84; B65H 2406/3124; B65H 2406/122
See application file for complete search history.

(56) References Cited

U.S. PATENT DOCUMENTS

| | | | | |
|---|---|---|---|---|
| 6,698,681 | B1 * | 3/2004 | Guy | B65H 18/22 242/532.2 |
| 9,511,968 | B2 * | 12/2016 | Malmqvist | B65H 19/265 |
| 9,828,201 | B2 * | 11/2017 | Malmqvist | B65H 20/06 |
| 10,239,720 | B2 * | 3/2019 | Seymour | B29C 59/046 |
| 2011/0017860 | A1 | 1/2011 | Vaughn et al. | |
| 2019/0161302 | A1 * | 5/2019 | Techlin | B65H 18/10 |

FOREIGN PATENT DOCUMENTS

| | | | |
|---|---|---|---|
| WO | WO 2005/026030 | A1 | 3/2005 |
| WO | WO 2014/158071 | A1 | 10/2014 |
| WO | WO 2015/105444 | A1 | 7/2015 |

* cited by examiner

APPARATUS FOR WINDING A WEB OF PAPER MATERIAL AND A METHOD OF REMOVING DUST

CROSS REFERENCE TO RELATED APPLICATIONS

This application is a National Stage Application, filed under 35 U.S.C. 371, of International Application No. PCT/EP2017/054449, filed Feb. 27, 2017, which international application claims priority to Swedish Application No. 1650602-4, filed May 4, 2016; the contents of both of which as are hereby incorporated by reference in their entirety.

BACKGROUND

Related Field

The present invention relates to an apparatus for winding a web of paper material into a roll and to a method of removing dust particles from an apparatus for winding a web of paper material into a roll.

Description of Related Art

In paper making machines, the ready-made paper web is wound on a reel to form a paper roll. This is made in a device usually referred to as a reel-up. In many reel-ups, the winding/reeling operation is made in a Pope-type reel-up in which a supporting cylinder is pressed against the paper reel as the paper web is being wound onto a reel. In U.S. Pat. No. 5,901,918, a different kind of reel-up is disclosed in which the paper roll is wound against a flexible member such as a flexible belt. By measuring the deflection of the belt and adjusting the position of the reel spool relative to the belt, it is possible to control the nip pressure between the belt and the paper roll. The kind of reel-up disclosed in U.S. Pat. No. 5,901,918 is often referred to as a belt reel. The object of the present invention is to improve the operation of a belt reel such that operation becomes more reliable. This object is achieved by means of the present invention as will be explained in the following.

BRIEF SUMMARY

The inventive apparatus for winding a web of paper material into a roll comprises a rotatably mounted reel spool onto which a paper web can be wound to create a roll of increasing diameter. The inventive apparatus also comprises an endless flexible belt which is permeable to air and supported by a plurality of support rolls for rotation along a predetermined path of travel. The endless flexible belt thus forms a loop and the predetermined path of travel is defined by the path of the endless flexible belt around the support rolls. The endless flexible belt is positioned adjacent to the reel spool to engage the web against the reel spool during winding such that the endless flexible belt is deflected from the predetermined path of travel by an amount relative to the amount of paper wound on the reel spool. The endless flexible belt has a web-contacting side that contacts the paper on the reel spool during winding and an inner side facing away from the paper on the reel spool. The inventive apparatus also comprises a deflection sensor mounted adjacent to the endless flexible belt and the deflection sensor is arranged to measure the amount of deflection of the endless flexible belt from the predetermined path of travel. The inventive apparatus further comprises an actuator for positioning the reel spool and the endless flexible belt relative to each other to vary the amount of deflection of the endless flexible belt. A controller is connected to the deflection sensor and the actuator for controlling the amount of deflection of the endless flexible belt as the roll increases in diameter. Moreover, the inventive apparatus comprises a device generating underpressure located inside the loop of the endless flexible belt and arranged to create an underpressure on the inside of the loop such that a paper web travelling on the endless flexible belt towards the rotatably mounted spool will be drawn against the endless flexible belt. The apparatus further comprises at least one cleaning device which cleaning device comprises at least one air nozzle and which cleaning device is arranged to be capable of blowing pressurized air against at least one of the two sides of the endless flexible belt. According to the invention, the at least one cleaning device is arranged to blow air against the web-contacting side of the endless flexible belt at a point where the endless flexible belt is not in contact with the paper material such that dust particles will be removed from the surface of the web-contacting side of the endless flexible belt.

In embodiments of the invention, the at least one cleaning device is arranged to be capable of blowing pressurized air over at least 80% of the width of the endless flexible belt and preferably over at least 90% of the width of the endless flexible belt.

In embodiments of the invention, the at least one air nozzle is arranged at such a distance from the endless flexible belt and at such an angle relative to the surface of the flexible member that pressurized air from the at least one nozzle does not have to travel more than 25 mm from the nozzle until it reaches the surface of the endless flexible belt. In such embodiments, the distance between the at least one nozzle and the endless flexible belt may optionally be in the range of 5 mm-20 mm and preferably in the range of 10 mm-15 mm.

In embodiments of the invention, the at least one cleaning device may be arranged to blow air against the inner side of the endless flexible belt.

In embodiments of the invention, the at least one cleaning device comprises a plurality of nozzles arranged to blow pressurized air against at least one side of the endless flexible belt 5 and wherein the nozzles are distributed in a direction perpendicular to the direction in which the endless flexible belt moves and which plurality of nozzles extend over the entire width of the endless flexible belt such that at least one side of the endless flexible belt can be exposed to pressurized air over its entire width.

In embodiments using a plurality of nozzles, the plurality of nozzles may extend in a straight row over the entire width of the endless flexible belt.

In embodiments of the invention, the at least one cleaning device comprises at least one nozzle arranged to blow pressurized air against at least one side of the endless flexible belt and which at least one nozzle is arranged to be movable in a direction that is at least partially perpendicular to the direction in which the endless flexible belt moves as it follows its predetermined path.

The invention also relates to a method of using the inventive apparatus. The method comprises blowing pressurized air against at least one of the two sides of the endless flexible belt such that dust particles are blown off from the endless flexible belt and the method comprises blowing air against the web-contacting side of the endless flexible belt at a point where the endless flexible belt is not in contact with the paper material such that dust particles will be removed from the surface of the web-contacting side of the endless flexible belt.

In embodiments of the invention, the method comprises blowing air against the inner side of the endless flexible belt.

In embodiments of the inventive method, pressurized air is blown over the entire width of the endless flexible belt.

In embodiments of the inventive method, at least one nozzle that blows pressurized air against the endless flexible belt is moved across the flexible member in a direction that is at least partially perpendicular to the direction in which the endless flexible belt moves as it follows its predetermined path.

In embodiments of the inventive method, at least one nozzle blows pressurized air against the web-contacting side of the endless flexible belt at a point where the endless flexible belt passes over a support roll such that the air is blown against the web-contacting side of the endless flexible belt when the inner side of the endless flexible belt contacts the support roll.

In embodiments of the inventive method, the cleaning device is supplied with pressurized air which has an overpressure which is 3 bar or higher. For example, the overpressure may be in the range of 3-25 bar, 3-16 bar, 3-10 bar or 4-8 bar. The overpressure may also be higher than 25 bar.

DETAILED DESCRIPTION OF VARIOUS EMBODIMENTS

Figure 1:
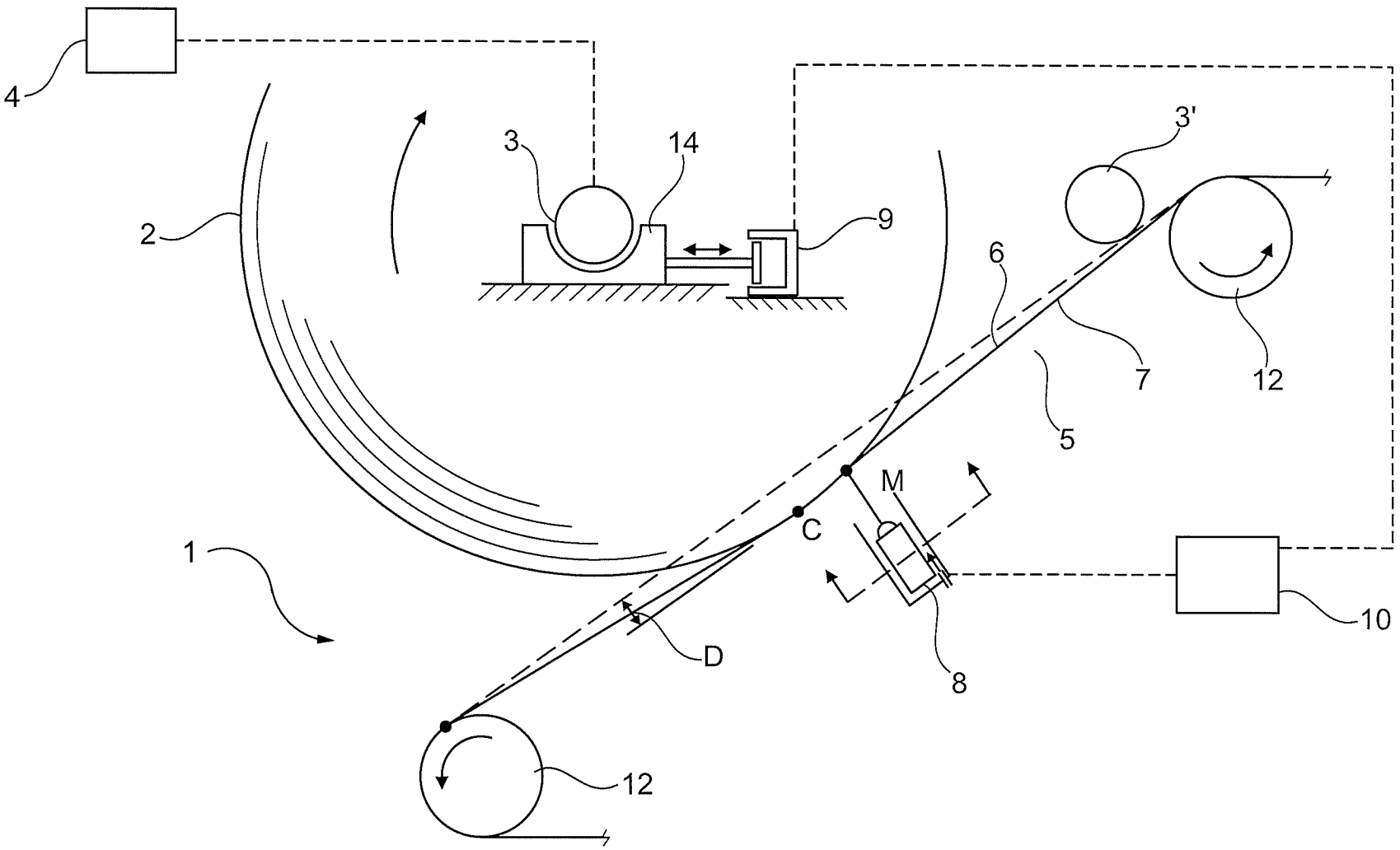
FIG. 1 is a schematic side view of a part of the kind of reel-up that the present invention relates to and for which the present invention is to be used.

With reference to FIG. 1, the general function of the inventive apparatus 1 is shown. The inventive apparatus 1 which may alternatively be termed a reel-up and it is designed for reeling/winding a web of paper material into a roll 2. For the purpose of reeling/winding the paper material, i.e. a paper web, the apparatus functions in the way generally disclosed in U.S. Pat. No. 5,901,918. A paper web W is carried by an endless flexible belt 5 The paper material, i.e. the paper web, is carried by the endless flexible belt 5 to a nip point C where the endless flexible member 5 engages the paper web against a reel spool 3 that is rotatably mounted in a carriage 14. Although not visible in FIG. 1, it should be understood that each axial end of the reel spool is suitably supported in such a carriage. As the paper web is wound on the reel spool 3, a paper roll 2 of increasing diameter is formed. The endless flexible belt 5 is mounted for rotation along a predetermined path of travel and positioned adjacent to the reel spool 3 to engage the web against the reel spool 3 during winding. The endless flexible belt 5 is supported by a plurality of support rolls 12 such that the endless flexible belt 5 forms a loop where the predetermined path of travel is defined by the path of travel of the endless flexible belt 5 around the support rolls 12. The endless flexible belt 5 has a web-contacting side 6 that contacts the paper on the reel spool 3 during winding and an inner side 7 facing away from the paper on the reel spool 3. The reference numeral 3' in FIG. 1 represents an empty reel spool that will be taken into use when the paper roll 2 on the current reel spool 3 has reached its full size and a new reel spool is needed. A drive motor symbolically indicated by reference numeral 4 may be arranged to drive (rotate) the reel spool 3. As described in U.S. Pat. No. 5,901,918, the paper roll 2 will cause the endless flexible belt to be deflected to some extent from its predetermined path of travel by a distance D (see FIG. 1). It will be understood that, as the paper roll 2 grows, this will cause a certain amount of deflection D that is relative to the amount of paper wound on the reel spool 3. If the reel spool 3 were to remain stationary, this would cause the deflection D to increase and the nip force between the paper roll 2 and the endless flexible belt would thereby also increase. The gradually increasing nip force would be contrary to the desired objective of maintaining constant product properties and should therefore be avoided. To keep the nip force within predetermined limits, the position of the reel spool 3 can be changed as explained in U.S. Pat. No. 5,901,918. This can be achieved in the following way. A deflection sensor 8 measures the amount of deflection D from the predetermined path of travel and gives a signal to a controller 10 that may be a computer. The sensor 8 may be a laser sensor but other sensors capable of measuring the deflection could also be used. The controller 10 is connected, for example by wire or by wire-less communication, to an actuator 9 that is arranged for positioning the reel spool 3 such that the reel spool 3 and the endless flexible belt can be positioned relative to each other. In this way, the amount of deflection D of the endless flexible belt 5 can be controlled which allows a control of the winding process to maintain substantially constant sheet properties throughout the paper roll 2. For a more detailed explanation of these aspects, reference is made to U.S. Pat. No. 5,901,918.

Figure 2:
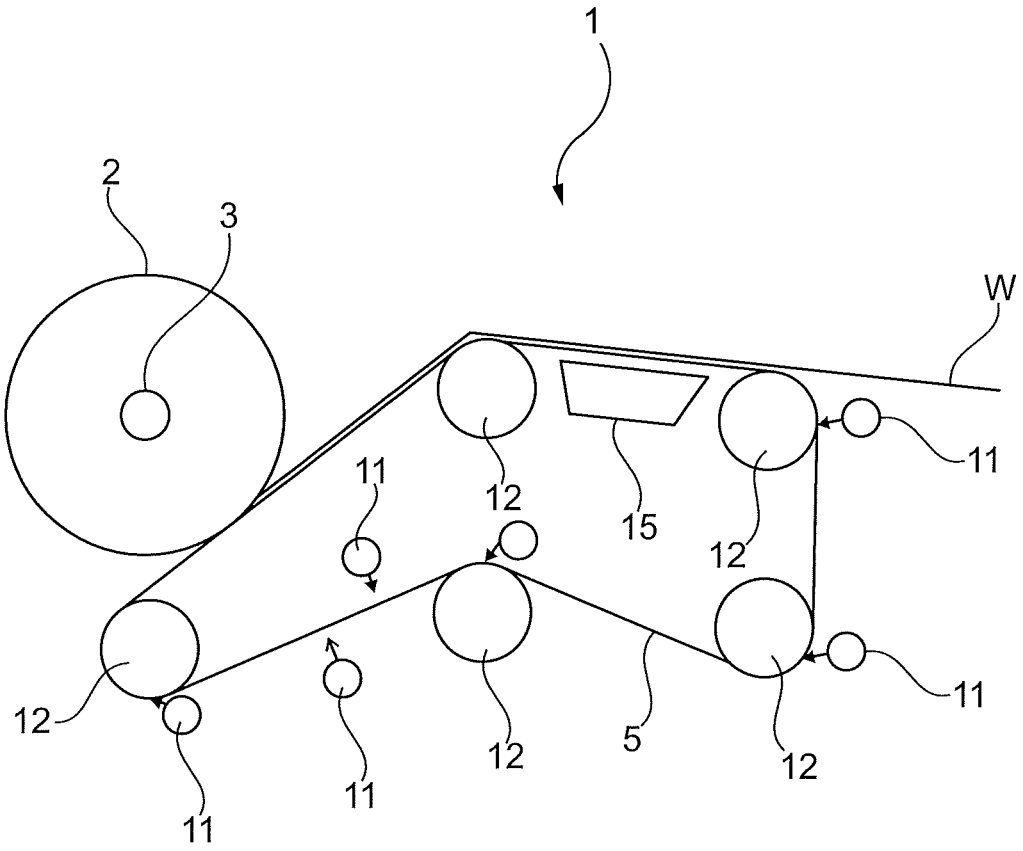
FIG. 2 is a side view substantially similar to FIG. 1 but in which the inventive equipment according to the present invention is indicated.

Reference will now be made to FIG. 2. In order to ensure that the paper web W remains in good contact with the endless flexible belt 5 until the paper web W is wound onto the reel spool 3, the endless flexible belt may be permeable to air and a device 15 generating underpressure can be located inside the loop of the endless flexible belt 5 and arranged to create an underpressure on the inside of the loop such that a paper web W travelling on the endless flexible belt 5 towards the rotatably mounted spool 3 will be drawn against the endless flexible belt 5. The device 15 that is arranged to/designed for generating an underpressure may be, for example, a blow box or a suction box. The inventors of the present invention have noted that, after the reel-up has been in operation for some time, the paper web is not always drawn against the flexible belt 5 as much as would be desirable. The inventors have found that this is because the endless flexible belt 5 that is designed to be permeable to air may become clogged by fine fiber particles such that the permeability of the endless flexible belt decreases and the underpressure generated by the device 15 is no longer sufficient to draw the paper web W against the endless flexible belt 5, at least not as much as would be desirable. Since the loop formed by the endless flexible belt 5 may often be open on its sides, fibers and other dust particles may clog the endless flexible belt both from the web-contacting side 6 and the inner side 7. To solve this problem, the inventors found that the endless flexible belt 5 should be cleaned, either continuously or intermittently. The inventors have contemplated a solution in which the endless flexible belt 5 is cleaned by a liquid, for example by means of jets of water directed against the endless flexible belt 5. However, the inventors found that, while jets of water may be used for cleaning the endless flexible belt 5, such a solution has drawbacks. One disadvantage of using water jets is that the endless flexible belt 5 will make the endless flexible belt 5 wet which is undesirable since the endless flexible belt 5 will contact the paper web W which should be kept dry at this stage. It would of course be possible to take extra steps to dry the belt after cleaning with water but that would add an extra difficulty. Moreover, the inventors have found that cleaning with water jets is not as effective in removing dust particles as was originally expected. In fact, dust particles such as particles from paper fibers can be packed into small openings in the endless flexible belt 5 such that the belt 5 becomes clogged in spite of the cleaning operation. The inventors then found that jets of pressurized air have a good cleaning effect that counteracts clogging of the endless flexible belt 5. The use of pressurized air also means that the endless flexible belt 5 will not become wet.

Therefore, according to the present invention, the apparatus for winding further comprises a cleaning device 11 which cleaning device comprises at least one air nozzle 13 and which cleaning device is arranged to be capable of blowing pressurized air against at least one of the two sides 6, 7 of the endless flexible belt 5.

Figure 3:
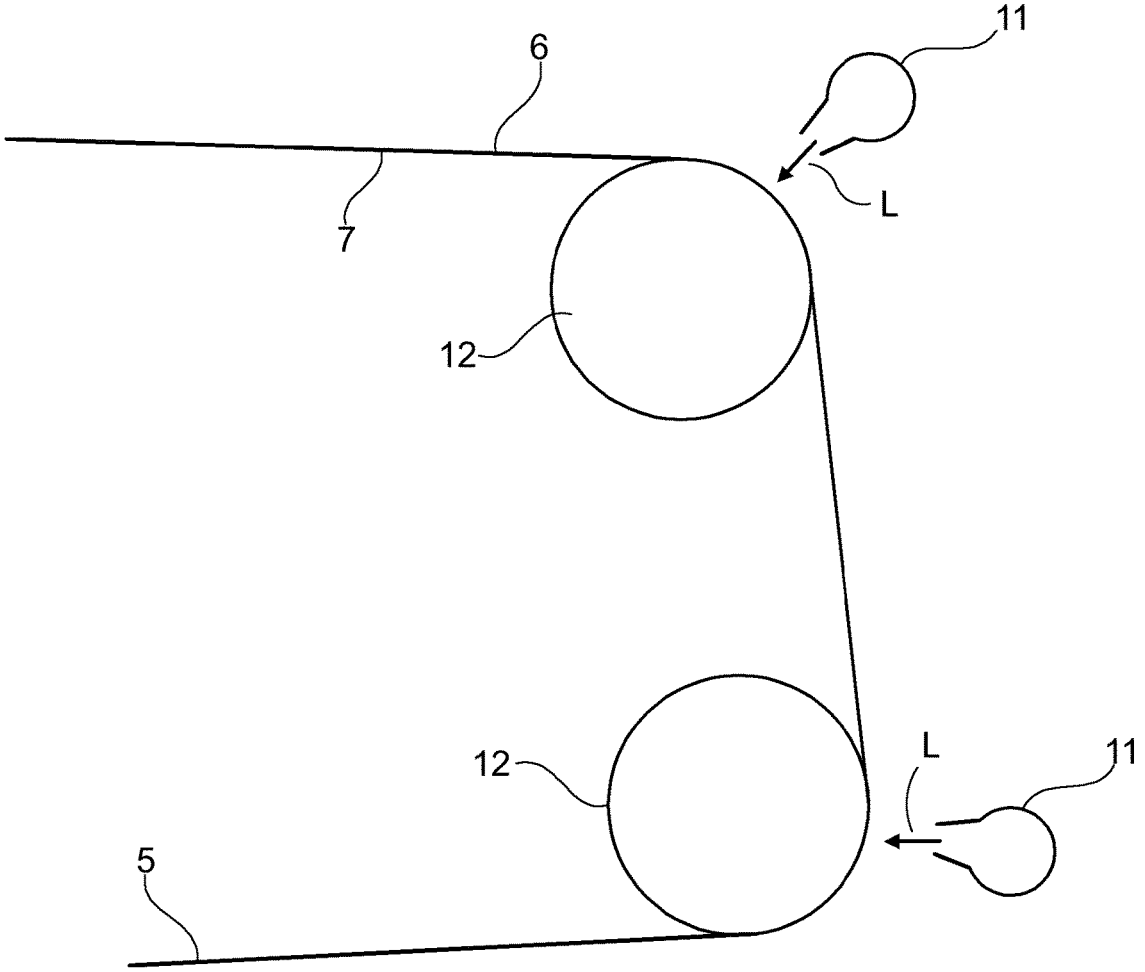
FIG. 3 shows a part of the equipment according to FIG. 2 and in FIG. 3, those parts are enlarged.

With reference to FIG. 2 and to FIG. 3, some alternative positions of the web-cleaning device 11 are shown.

As indicated in FIG. 2, the web-cleaning device 11 may be placed both inside the loop of the endless flexible belt 5 and on the outside of the loop. It should be understood that, in a real embodiment, the web-cleaning device 11 is not necessarily used in all positions indicated in FIG. 2. Embodiments using only one web-cleaning device 11 are conceivable, for example embodiment with only one web-cleaning device 11 placed on the outside of the loop such that it can blow pressurized air against the web-contacting side 6. In the same way, embodiments are conceivable in which a single web-cleaning device is placed inside the loop and arranged to blow pressurized air against the inner side 7 of the endless flexible belt 5. Preferably, at least one cleaning device 11 is placed inside the loop of the endless flexible belt 5 while at least one cleaning device 11 is placed outside the loop of the endless flexible belt 5 such that pressurized air can be blown against the endless flexible belt 5 from both sides. Embodiments are also conceivable with three, four or more cleaning devices 11. For example, there could be five cleaning devices 11 placed as indicated in FIG. 2.

With reference to FIG. 3, cleaning devices 11 are shown as being placed outside the loop of the endless flexible belt 5. The arrows L symbolically indicate pressurized air being blown by the cleaning devices 11 against the web-contacting side 6 (i.e. the outer side) of the endless flexible belt 5.

Preferably, the at least one cleaning device 11 is arranged to be capable of blowing pressurized air over at least 80% of the width of the endless flexible belt 5 and preferably over at least 90% of the width of the endless flexible belt 5. In many practical embodiments, the at least one cleaning device 11 may be arranged to be capable of blowing pressurized air over the entire width of the endless flexible belt 5 and it is also preferable that the cleaning device 11 is capable of blowing pressurized air over the entire width of the endless flexible belt 5

Preferably, the at least one air nozzle is arranged at such a distance from the endless flexible belt 5 and at such an angle relative to the surface of the endless flexible belt 5 that pressurized air from the at least one nozzle does not have to travel more than 25 mm from the nozzle until it reaches the surface of the endless flexible belt 5. The reason is that, when the air jet reaches the endless flexible belt 5, it should still have enough energy to blow dust particles away. Here, it may be added that the distance depends on the actual overpressure used in the pressurized air that is used. A higher overpressure normally means that the distance can be higher. However, a lower overpressure means that less energy is required and less noise is generated. For this reason, it may be desirable to use a short distance.

In embodiments of the invention, the distance between nozzle and belt could be almost reduced to zero but since the path of the belt may be disturbed and since the nozzle should preferably not come into contact with the endless flexible belt 5, it may be advantageous to keep a certain distance. The inventors have found that it may be suitable to select the distance so that the distance between the at least one nozzle 13 and the endless flexible belt 5 is in the range of 5 mm-20 mm and preferably in the range of 10 mm-15 mm in order to reduce the risk that the at least one nozzle 13 comes into contact with the flexible belt 5 while still being so close to the belt 5 that effective removal of dust is ensured.

The at least one cleaning device 11 is arranged to blow air against the web-contacting side 6 of the endless flexible belt 5. This is of course done at a point where the endless flexible belt 5 is not in contact with the paper material such that dust particles will be removed from the surface of the web-contacting side 6 of the endless flexible belt 5. It may then be placed such that it is then to blow pressurized air against the endless flexible belt 5 at a point which is at a certain distance from the nip point C such that dust particles are not blown towards the paper web W and the roll 2.

In embodiments of the invention, the cleaning device 11 is arranged to blow air against the web-contacting side 6 of the endless flexible belt 5 at a point where the endless flexible belt 5 passes over a support roll 12 such that the air is blown against the web-contacting side 6 of the endless flexible belt when the inner side 7 of the endless flexible belt 5 contacts the support roll 12. This aspect of the invention is shown in FIG. 3 and examples are also shown in FIG. 2.

Figure 4:
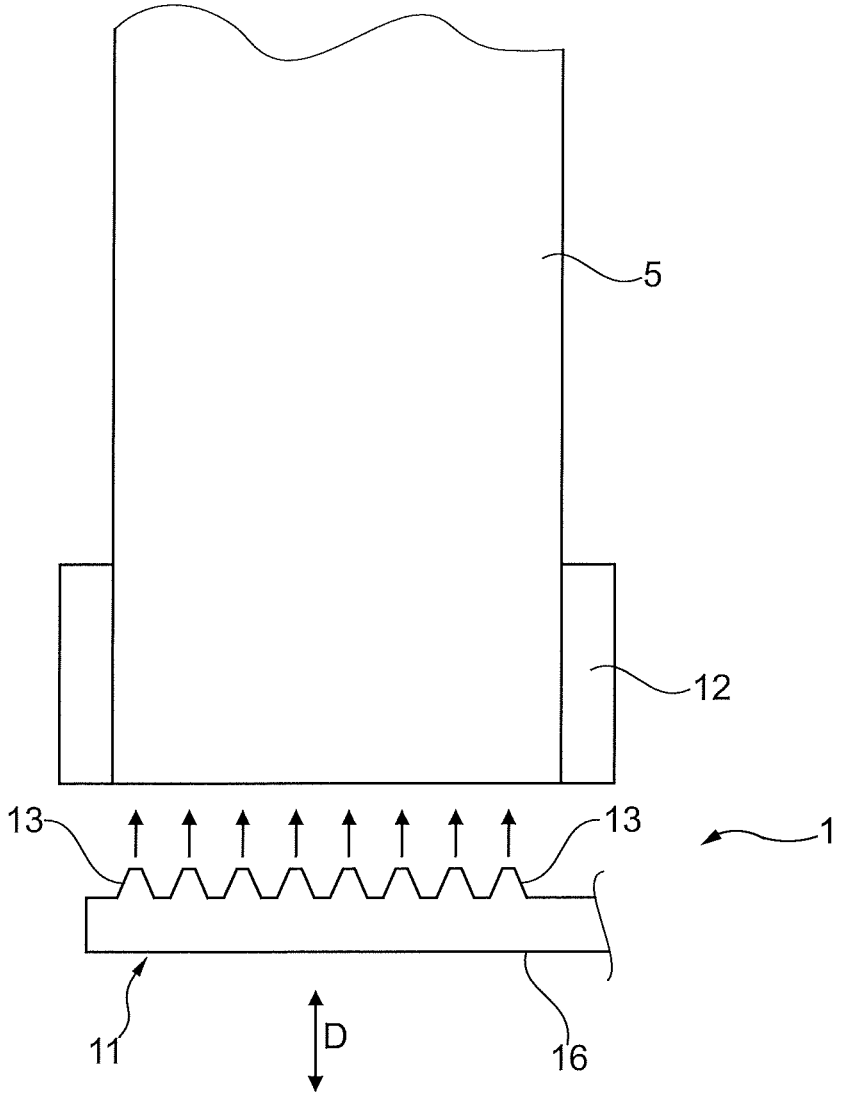
FIG. 4 shows how the invention can be realized according to a first embodiment.

One possible embodiment will now be explained with reference to FIG. 4. FIG. 4 shows a view in the cross machine direction. In FIG. 4, the cleaning device 11 comprises a plurality of nozzles 13 arranged to blow pressurized air against at least one side 6, 7 of the endless flexible belt 5. In FIG. 4 as well as in FIG. 5, the reference numeral 16 indicates a supply conduit/supply tube for pressurized air. In the embodiment of FIG. 4, the nozzles 13 are distributed in a direction perpendicular to the direction in which the endless flexible belt 5 moves, i.e. they are distributed in the cross machine direction. In FIG. 4, the plurality of nozzles 13 extends over the entire width of the endless flexible belt 5 such that at least one side 6, 7 of the endless flexible belt 5 can be exposed to pressurized air over its entire width. It should be understood that embodiments are conceivable in which the nozzles 13 cover only a part of the width of the endless flexible belt 5. In such embodiments, a first cleaning device could be arranged to cover one part of the width of the endless flexible belt 5 while a second (subsequent) cleaning device 11 covers those parts that have not been exposed to the nozzles 13 of the first cleaning device. The plurality of nozzles 13 may be arranged in different patterns over the width of the endless flexible belt 5. For example, they may be arranged in a wave pattern. For simplicity, it is preferred that the plurality of nozzles 13 extends in a straight row over the entire width of the endless flexible belt 5.

In FIG. 4, the arrow D indicates that the cleaning device 11 may be movable towards or away from the endless flexible belt 5 such that the distance between the cleaning device 11 and the endless flexible belt 5 can be varied, for example if there is a risk that the nozzles 13 should come into contact with the belt such that the cleaning device 11 must be moved away from the belt 5. Correspondingly, the cleaning device 11 can be moved closer to the belt 5 for more effective cleaning. An actuator/drive arrangement (not shown) may be connected to the cleaning device 11 and arranged to move the cleaning device towards or away from the endless flexible belt 5.

Figure 5:
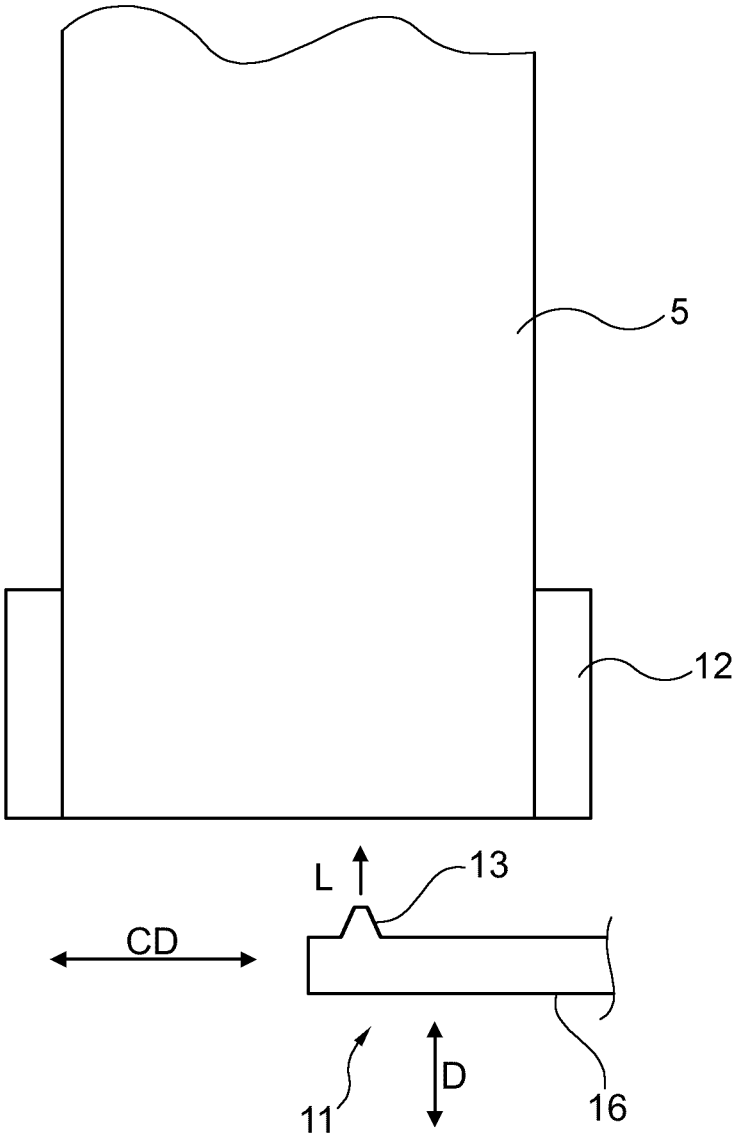
FIG. 5 is a view similar to FIG. 4 but showing an alternative embodiment.

An embodiment will now be explained with reference to FIG. 5. In the embodiment of FIG. 5, the cleaning device 11 comprises at least one nozzle 13 arranged to blow pressurized air against at least one side 6, 7 of the endless flexible belt 5. The at least one nozzle 13 is arranged to be movable in a direction CD that is at least partially perpendicular to the direction in which the endless flexible belt 5 moves as it follows its predetermined path. Preferably, it is movable in a direction that is at 90° to the direction in which the endless flexible belt 5 moves. An actuator/drive arrangement (not shown) may be connected to the cleaning device 11 and arranged to move the cleaning device in the CD direction as indicated by arrow CD. Just as in the embodiment of FIG. 4, the cleaning device 11 may be movable towards or away from the endless flexible belt 5

It will now be understood that the inventive method comprises blowing pressurized air against at least one of the two sides 6, 7 of the endless flexible belt 5 such that dust particles are blown off from the endless flexible belt 5. The air is blown at the web-contacting side 6 of the endless flexible belt or against both the inner side 7 and the web-contacting side 6.

When air is blown against the web-contacting side 6 of the endless flexible belt 5, this is made at a point where the endless flexible belt 5 is not in contact with the paper material such that dust particles will be removed from the surface of the web-contacting side 6 of the endless flexible belt 5.

Pressurized air is preferably blown over the entire width of the endless flexible belt 5.

The cleaning device may preferably be supplied with pressurized air that has an overpressure that is at least 3 bar, preferably higher than 3 bar. For example, the overpressure may be in the range of in the range of 3-25 bar, 3-16 bar, 3-10 bar or 4-8 bar. The overpressure may also be higher than 25 bar.

Thanks to the present invention, the contact between the paper web W and the endless flexible belt 5 is improved which improves the operation of the reel-up.

While the invention has been described here in terms of an apparatus and a method, it should be understood that these categories only reflect different aspects of one and the same invention. The inventive method may therefore include such steps that would be the inevitable consequence of using the inventive apparatus, regardless of whether such steps have been explicitly mentioned or not.

The invention claimed is:

1. An apparatus (1) for winding a web of paper material into a roll (2), the apparatus (1) comprising:

a rotatably mounted reel spool (3) onto which a paper web can be wound to create a roll (2) of increasing diameter;

an endless flexible belt (5) which is permeable to air and supported by a plurality of support rolls (12) for rotation along a predetermined path of travel such that the endless flexible belt (5) forms a loop and wherein the predetermined path of travel is defined by the path of the endless flexible belt (5) around the support rolls (12), the endless flexible belt (5) being positioned adjacent to the reel spool (3) to engage the web against the reel spool (3) during winding such that the endless flexible belt (5) is deflected from the predetermined path of travel by an amount relative to the amount of paper wound on the reel spool (3), the endless flexible belt (5) having a web-contacting side (6) that contacts the paper on the reel spool (3) during winding and an inner side (7) facing away from the paper on the reel spool (3);

a deflection sensor (8) mounted adjacent to the endless flexible belt (5), the deflection sensor (8) being arranged to measure the amount of deflection of the endless flexible belt (5) from the predetermined path of travel;

an actuator (9) for positioning the reel spool (3) and the endless flexible belt (5) relative to each other to vary the amount of deflection of the endless flexible belt (5);

a controller (10) connected to the deflection sensor (8) and the actuator (9) for controlling the amount of deflection of the endless flexible belt (5) as the roll (2) increases in diameter;

a device generating underpressure located inside the loop of the endless flexible belt and arranged to create an underpressure on the inside of the loop such that a paper web travelling on the endless flexible belt (5) towards the rotatably mounted spool (3) will be drawn against the endless flexible belt (5); and at least one cleaning device (11), which cleaning device comprises at least one air nozzle and which cleaning device is arranged to be capable of blowing pressurized air against at least one of the two sides (6, 7) of the endless flexible belt (5), wherein the at least one cleaning device (11) is arranged to blow air against the web-contacting side (6) of the endless flexible belt (5) at a point where the endless flexible belt (5) is not in contact with the paper material such that dust particles will be removed from the surface of the web-contacting side (6) of the endless flexible belt (5).

2. An apparatus according to claim 1, wherein the at least one cleaning device is arranged to be capable of blowing pressurized air over at least 80% of the width of the endless flexible belt.

3. An apparatus according to claim 1 in which the at least one air nozzle (13) is arranged at such a distance from the endless flexible belt (5) and at such an angle relative to the surface of the flexible member that pressurized air from the at least one nozzle (13) does not have to travel more than 25 mm from the nozzle (13) until it reaches the surface of the endless flexible belt (5).

4. An apparatus according to claim 3, wherein the distance between the at least one nozzle (13) and the endless flexible belt (5) is in the range of 5 mm-20 mm.

5. An apparatus according to claim 3, wherein the distance between the at least one nozzle (13) and the endless flexible belt (5) is in the range of 10 mm-15 mm.

6. An apparatus (1) according to claim 1, wherein the at least one cleaning device (11) is arranged to blow air against the inner side (7) of the endless flexible belt (5).

7. An apparatus (1) according to claim 1, wherein the at least one cleaning device (11) is arranged to blow air against the web-contacting side (6) of the endless flexible belt (5) at a point where the endless flexible belt (5) passes over a support roll (12) such that the air is blown against the web-contacting side (6) of the endless flexible belt when the inner side (7) of the endless flexible belt (5) contacts the support roll (12).

8. An apparatus (1) according to claim 1, wherein:

the at least one cleaning device (11) comprises a plurality of nozzles (13) arranged to blow pressurized air against at least one side (6, 7) of the endless flexible belt (5); and the nozzles (13) are distributed in a direction perpendicular to the direction in which the endless flexible belt (5) moves and which plurality of nozzles (13) extend over the entire width of the endless flexible belt (5) such that at least one side (6, 7) of the endless flexible belt (5) can be exposed to pressurized air over its entire width.

9. An apparatus (1) according to claim 8, wherein the plurality of nozzles (13) extend in a straight row over the entire width of the endless flexible belt (5).

10. An apparatus (1) according to claim 1, wherein:

the at least one cleaning device (11) comprises at least one nozzle (13) arranged to blow pressurized air against at least one side (6, 7) of the endless flexible belt (5); and the at least one nozzle (13) is arranged to be movable in a direction that is at least partially perpendicular to the direction in which the endless flexible belt (5) moves as it follows its predetermined path.

11. A method of removing dust particles from an apparatus (1) according to claim 1, wherein the method comprises the steps of:

blowing pressurized air against at least one of the two sides (6, 7) of the endless flexible belt (5) such that dust particles are blown off from the endless flexible belt (5); and blowing air against the web-contacting side (6) of the endless flexible belt (5) at a point where the endless flexible belt (5) is not in contact with the paper material such that dust particles will be removed from the surface of the web-contacting side (6) of the endless flexible belt (5).

12. A method according to claim 11, wherein the method also comprises blowing air against the inner side (7) of the endless flexible belt (5).

13. A method according to claim 11, wherein pressurized air is blown over the entire width of the endless flexible belt (5).

14. A method according to claim 13, wherein at least one nozzle (13) that blows pressurized air against the endless flexible belt (5) is moved across the endless flexible belt (5) in a direction that is at least partially perpendicular to the direction in which the endless flexible belt (5) moves as it follows its predetermined path.

15. A method according to claim 11, wherein at least one nozzle (13) blows pressurized air against the web-contacting side (6) of the endless flexible belt (5) at a point where the endless flexible belt (5) passes over a support roll (12) such that the air is blown against the web-contacting side (6) of the endless flexible belt when the inner side (7) of the endless flexible belt contacts the support roll (12).

16. A method according to claim 11, wherein the cleaning device (11) is supplied with pressurized air which has an overpressure which is at least 3 bar.

17. An apparatus according to claim 1, wherein the at least one cleaning device is arranged to be capable of blowing pressurized air over at least 90% of the width of the endless flexible belt (5).

* * * * *